US006115859A

United States Patent [19]

Ozawa

[11] Patent Number: 6,115,859

[45] Date of Patent: Sep. 12, 2000

[54] MATTRESS AND PROCESS FOR PRODUCING STUFFING THEREFOR

[75] Inventor: Yasuo Ozawa, Gunma, Japan

[73] Assignee: Kabushiki Kaisha MaPePe Unit, Gunma, Japan

[21] Appl. No.: 09/043,024

[22] PCT Filed: Sep. 12, 1996

[86] PCT No.: PCT/JP96/02606

§ 371 Date: May 12, 1998

§ 102(e) Date: May 12, 1998

[87] PCT Pub. No.: WO97/09910

PCT Pub. Date: Mar. 20, 1997

[30] Foreign Application Priority Data

Sep. 12, 1995 [JP] Japan ..... 7-258281
Nov. 24, 1995 [JP] Japan ..... 7-327884

[51] Int. Cl.[7] ..... A47C 27/12; A47C 27/14; B32B 7/08; D01B 7/00

[52] U.S. Cl. ..... 5/690; 5/502; 442/221; 112/441; 19/3; 28/190

[58] Field of Search ..... 5/502, 690; 442/221, 442/224; 112/441, 440; 19/3; 28/190, 196

[56] References Cited

U.S. PATENT DOCUMENTS

| | | | |
|---|---|---|---|
| 202,125 | 4/1878 | Serrell, Jr. | 19/3 |
| 1,583,334 | 5/1926 | Bloom | 5/502 |
| 1,936,434 | 11/1933 | Jumonville | 112/475.08 X |
| 2,128,903 | 9/1938 | Beckman | 19/3 |
| 2,141,816 | 12/1938 | Kowada | 19/3 |
| 2,297,458 | 9/1942 | Castelli | 19/3 |
| 2,733,499 | 2/1956 | Granberg | 28/190 |
| 3,635,785 | 1/1972 | Hughes | 5/502 X |
| 4,154,267 | 5/1979 | Orr et al. | 28/191 X |
| 5,408,712 | 4/1995 | Brun | 5/502 |
| 5,855,032 | 1/1999 | Field | 5/502 |

*Primary Examiner*—Terry Lee Melius
*Assistant Examiner*—Rodrigo J. Morales
*Attorney, Agent, or Firm*—Birch, Stewart, Kolasch & Birch, LLP

[57] ABSTRACT

The body of a mattress comprises a cocoon thread bundle of long fibers formed by reeling cocoon threads off cocoons and separating them one from another. The body the mattress also has inner layers sandwiching the bundle. The body is quilted at appropriate positions and covered by a suface cloth made of woven fabric, and the periphery of the body is fastened by a retention cloth. The mattress has touch different from, for example feather mattress and serves to reduce yarn breakage of the cocoon long-fibers which are used as the stuffing. The stuffing can be easily produced without fail by a process comprising the steps of reeling cocoon threads off boiled cocoons and winding them around a take-up reel, fusing the wound cocoon threads at appropriate positional, and cutting the fused bundles.

13 Claims, 12 Drawing Sheets

MATTRESS AND PROCESS FOR PRODUCING STUFFING THEREFOR

This application is the national phase under 35 U.S.C. §371 of prior PCT International Application No. PCT/JP 96/02606 which has an International filing date of Sep. 12, 1996 which designated the United States of America, the entire contents of which are hereby incorporated by reference.

BACKGROUND OF THE INVENTION

1. Field of the Invention

The invention relates to a mattress having an excellent insulating property and provided with a high-grade feeling different from feathers and the like.

The invention further relates to a process for producing stuffing of the mattress and the like and a producing device used for the said process, and in detail the invention relates to a process for producing stuffing of a mattress or clothing and the like having an excellent insulating property and provided with a high-grade feeling different from feathers and the like and a producing device used for the said process.

2. Related Art

Hitherto, as stuffing of a mattress such as coverlet, bedding and the like and arctic clothes and the like, there have been used urethane, feather, hair, cotton or wool and the like having excellent insulating property, hygroscopicity and cushionability. In such mattress, when a short fiber was used for stuffing, there was a problem that the short fiber is slipped out of an inner layer. Therefore, various special treatments were applied to the inner layer, and a measure was planned to prevent the stuffing from slipping out. However, a process for applying any special treatment to the inner layer caused problems of not only lowering the touch and the feel but also a comparatively high producing cost.

Therefore, in recent years there has been developed a process for forming a continuous long fiber by twining or twisting short fibers together, using the said long fiber as stuffing, and preventing the stuffing from slipping out of an inner layer. Particularly, recently, there is developed silk applicable to the bedding field and the like by making the best use of the processing technique of raw silk. That is, as an available process for such silk, a silk thread prepared by twining a plurality of cocoon threads, each one of which is cotton like and floss made by waste cocoons unavailable as raw silk, are processed, and utilized as stuffing of the mattress, clothing, arctic outfits and the like.

However, a prior long fiber is continued by twining or twisting short fibers together, and in case of using it as stuffing of mattress, such long fiber per se becomes hard and invites a feeling of physical disorder in use and a lowering of the feel.

Furthermore, a silk thread prepared by twining a plurality of cocoon threads, each one of which is cotton-like, forms uneven twisted portions at the time of producing to become hemp-like; thus, making it impossible to obtain the touch of good quality. Moreover, in case of using floss made by waste cocoon, it is impossible to obtain the delicate touch, feel and high-grade feeling, and to suitably use such for stuffing of mattress and the like.

In case of using urethane, wool or cotton and the like, used until now as stuffing, such stuffing is excellent in mass-production and production cost, but rather unsatisfactory in touch and feel.

An object of the invention is, therefore, to prevent thread cutting of a long fiber, and to propose high-grade mattress provided with the touch, feel and insulating property different from feathers.

Moreover, another object of the invention is to propose a process for producing stuffing which can easily and positively produce mattress, clothing and arctic outfits and a producing device used for the said process.

SUMMARY OF THE INVENTION

A mattress of the invention is characterized in that a cocoon thread bundle of long fibers formed as a reeled thread by reeling cocoon threads off a plurality of cocoons and separating them one by one is sandwiched with inner layers from both the upper and lower sides to form the mattress body. Quilting is applied to appropriate portions of the mattress body. The circumference of the mattress body is covered with a surface cloth made of woven fabric, and the peripheral portion is fastened by a retention cloth.

The cocoon thread bundle of long fibers can be arranged in the longitudinal direction, the short-side direction or both the longitudinal direction and the short-side direction of the mattress. Moreover, it is possible to double the mattress body, to insert solid stuffing as a core member into the mattress body, and to cover the circumference of the mattress body with a surface cloth. In the mattress of the invention, the touch, feel and insulating property are improved. Also, thread cutting is prevented during a period of use, and a high-grade feeling is obtained.

Moreover, the invention relates to a process for producing stuffing which comprises steps of reeling cocoon threads off a plurality of boiled cocoons round a reel, sewing appropriate portions of the cocoon threads reeled round the reel, and cutting and processing a bundle of the sewed cocoon threads.

It is also preferable the bundle of the cocoon threads reeled round the reel is used as stuffing by sandwiching with two cloths.

Moreover, the invention relates to a device for producing stuffing which comprises a cocoon container for containing a plurality of boiled cocoons, an automatic reeler for reeling cocoon threads off cocoons within the cocoon container round a reel, a transverse suspension shaft arranged between the cocoon container and the reel, a sewing device having a long machine for sewing appropriate portions of the cocoon threads reeled round the reel, and a set table for cutting and processing a bundle of the sewed cocoon threads.

The reel is contractible in the longitudinal and/or vertical direction.

The above process and device can easily and positively produce stuffing of mattress and the like consisting of a bundle of cocoon threads having excellent insulating property, hygroscopicity and cushionability. That is, such stuffing is arranged in the state of separating cocoon threads of long fibers one by one and continuing from end to end of the mattress and the like, and as a result, a desired space is formed between threads, and an insulating property is excellent, every cocoon thread is independent, and there is no twisting or kinking trouble. Furthermore, since the cocoon thread per se contains sericin, there are moderate resiliency and toughness, thread cutting during a period of use can be mitigated, and an advantage of natural silk can effectively be exhibited, so that the high-grade feeling different from feathers can be obtained. Moreover, a bundle of cocoon threads produced as stuffing is sewed at appropriate portions so as to be free from fraying.

From the above, the stuffing produced from the process and the device of the invention can be utilized as the stuffing of not only mattress and the like such as a coverlet and a bedding but also a wrap, shortcoat, cushion or a pillow, and clothing, such as arctic outfits and the like.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detail description.

BRIEF DESCRIPTION OF THE DRAWINGS

The present invention will become more fully understood form the detailed description given hereinbelow and the accompanying drawings which are given by way of illustration only, and thus are not limitative of the present invention, and wherein.

DESCRIPTION OF THE PREFERRED EMBODIMENTS

Figure 1:
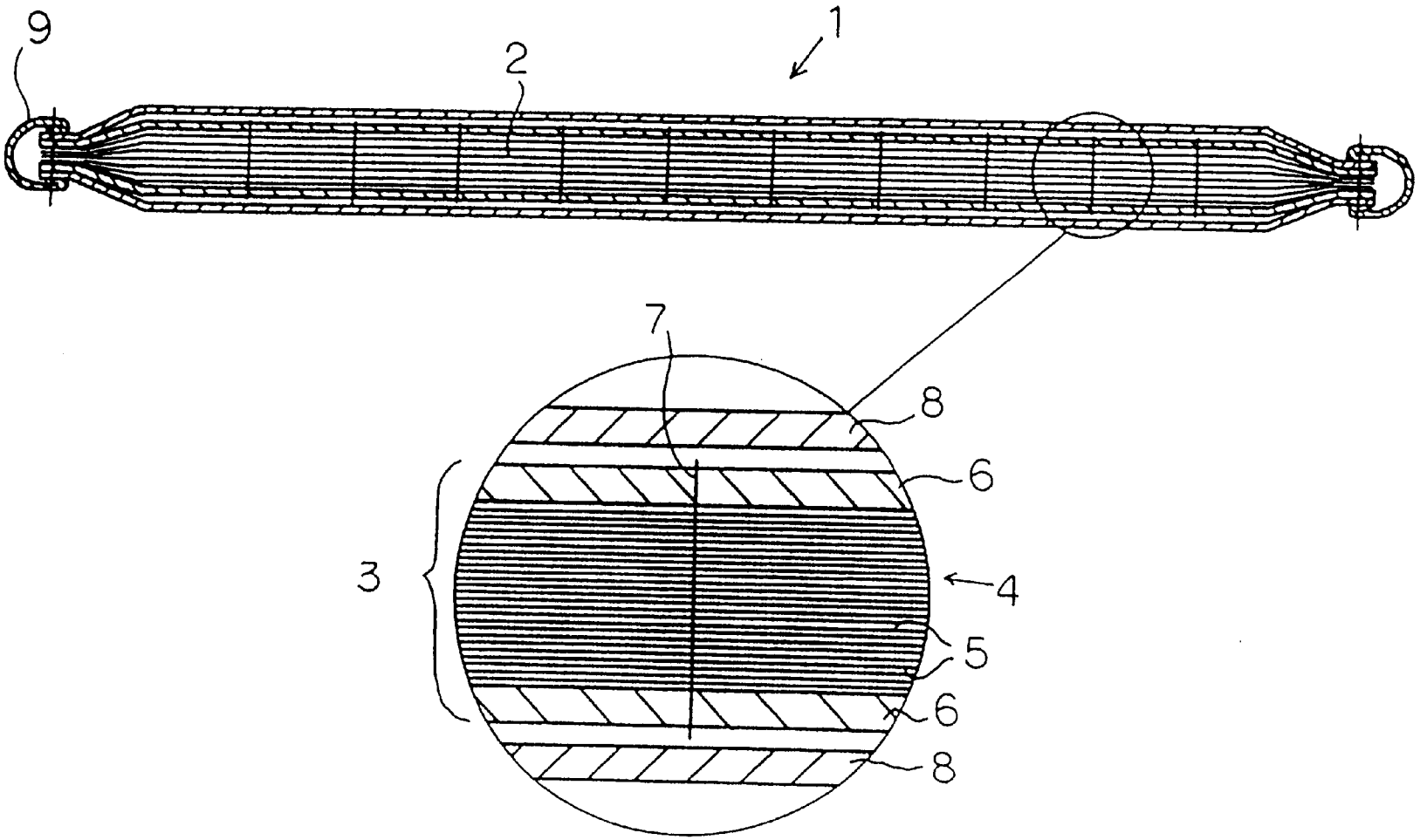
FIG. 1 is a cross section of one example mattress according to the invention.
Figure 2:
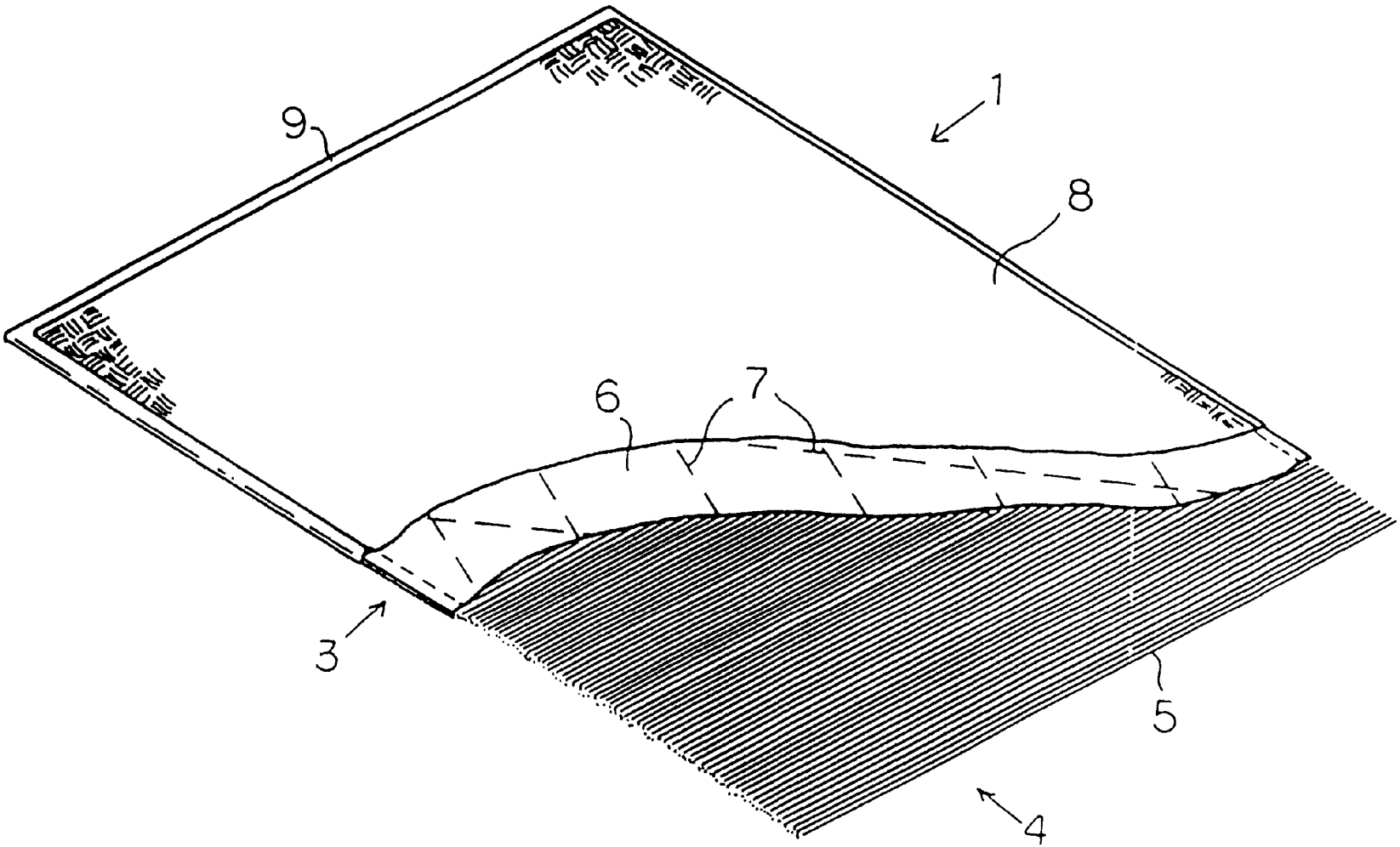
FIG. 2 is a partly cutaway perspective view of the mattress according, to the invention.

One example of the invention is explained by referring to FIGS. 1 and 2. A mattress 1 shown in FIGS. 1 and 2 is formed by covering a stuffing 2, an inner layer 6 for sandwiching the stuffing 2 from the upper and lower sides and a mattress body 3 formed by the inner layer 6 with a surface cloth 8.

The stuffing 2 consists of a cocoon thread bundle 4 produced by drawing cocoon threads 5 out of about 3,000–5,000 cocoons, respectively, separating one by one and reeling the cocoon threads. The cocoon thread bundle 4 is pulled by a draft device and cut into suitable length in accordance with a use.

The cocoon thread 5 for constructing the said cocoon thread bundle 4 is a long fiber of 2.5 denier to 3.0 denier in thickness, and one cocoon thread 5 is arranged in the continued state from end to end of the mattress 1.

The cocoon thread bundle 4 is sandwiched by the inner layer 6 from both the upper and lower sides, and applied with a quilting 7 for preventing slippage of the cocoon thread bundle 4.

Moreover, around the circumference of the side layer 6, in order to prevent thread cutting of the quilting 7, a surface cloth 8 consisting of a woven fabric is covered, while the peripheral portion of the mattress 1 is fastened by lock processing with the use of a retention cloth 9.

Figure 3:
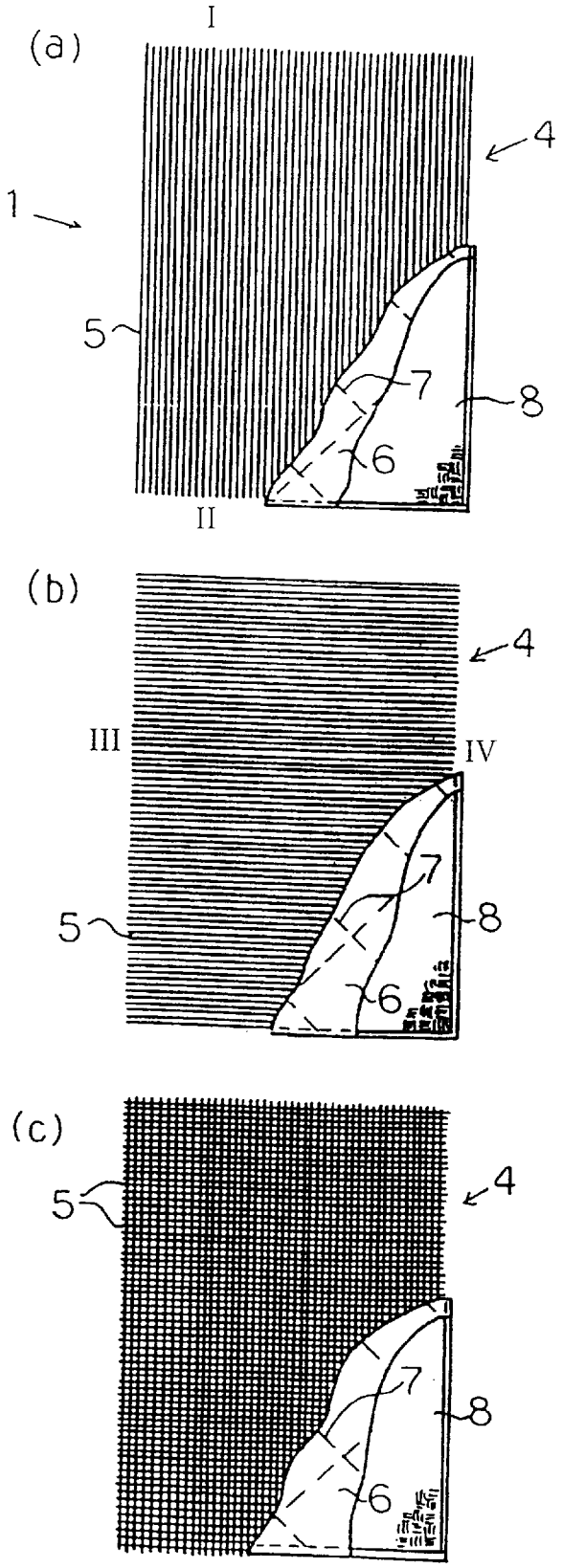
FIGS. 3(*a*), 3(*b*) and 3(*c*) are partially cutaway plan views showing the arranged state of bundle of cocoon threads in the mattress according to the invention.

FIGS. 3(*a*), (*b*) and (*c*) are partially cutaway plan views showing arrangement states of the cocoon thread bundle 4 in the mattress of the invention.

FIG. 3(*a*) shows a state of arranging the cocoon thread bundle 4 in the longitudinal direction of the mattress 1. The cocoon bundle 4 consists of a plurality of cocoons 5 arranged in the continuous state from an end I to the other end II of the mattress 1.

FIG. 3(*b*) shows a state of arranging the cocoon thread bundle 4 in the short-side direction of the mattress 1. The cocoon thread bundle 4 consists of a plurality of cocoons 5 arranged in the continuous state from an end III to the other end IV of the mattress 1.

FIG. 3(*c*) shows an arranged state by crossing the cocoon thread bundle 4 in the longitudinal direction and the short-side direction of the mattress 1.

Moreover, in the above (a), (b) and (c), the cocoon thread bundle 4 is sandwiched by the inner layer 6 from both the upper and lower sides, and applied with a quilting 7 for preventing slippage of the cocoon thread bundle 4. Furthermore, around the circumference of the inner layer 6, a surface cloth 8 is covered for preventing thread cutting and fraying of the quilting 7.

Figure 4:
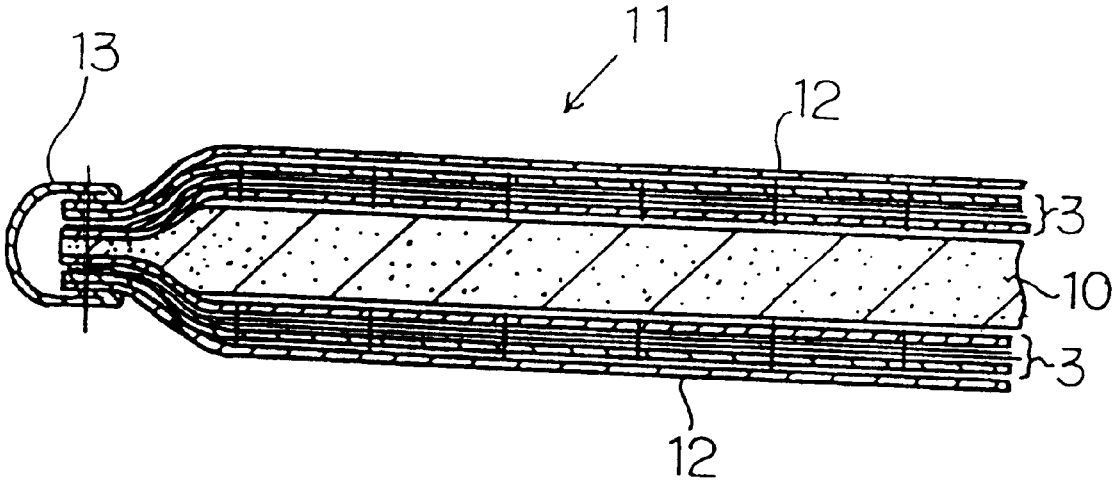
FIG. 4 is a cross section of another example mattress according to the invention.

FIG. 4 shows another example of the invention. A mattress 11 doubles a mattress body 3, and inserts a solid stuffing 10 as a core member between the mattress body 3. The solid stuffing 10 can suitably be selected from those consisting of chemical fiber materials such as nylon, polyester and the like, properly having resilience by compression processing, or feathers, wool and the like according to the purpose of use. The circumference of the mattress 11 having the aforementioned core member 10 is covered with a surface cloth 12 and the peripheral portion is fastened by a retention cloth 13.

Moreover, when a resilient member is used as the solid stuffing 10, the mattress 11 appropriately has strength, and is preferable to be utilized as a mattress.

Next, a process and a device for producing stuffing according to the invention is explained by referring to the drawings.

Figure 5:
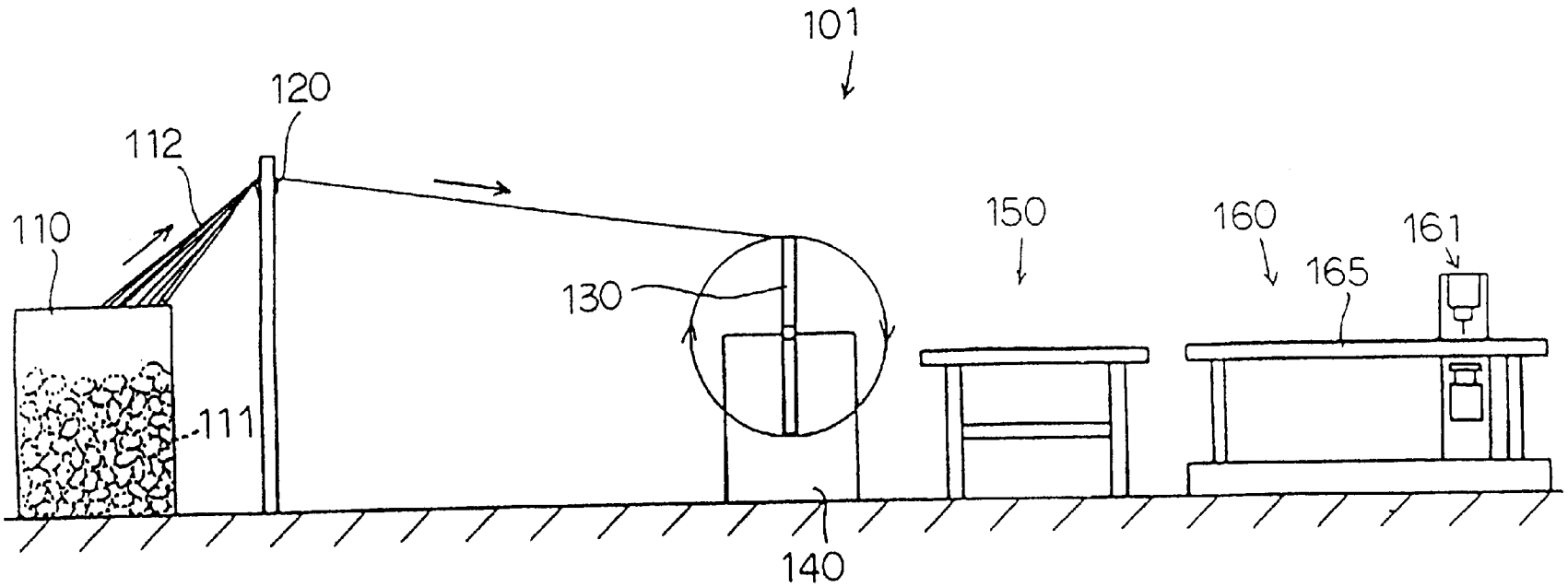
FIG. 5 is a general view of one example stuffing producing device according to the invention.

FIG. 5 is a general view showing one example stuffing producing device 101 of the invention used for carrying out a process according to the invention. The stuffing producing device 101 is composed of a cocoon container 110, a transverse suspension shaft 120, a reel 130, an automatic reeling device 140, a set table 150 and a sewing device 160. In the cocoon container 110 are contained a plurality of cocoons 111 boiled using boiling water, steam and the like.

Figure 13:
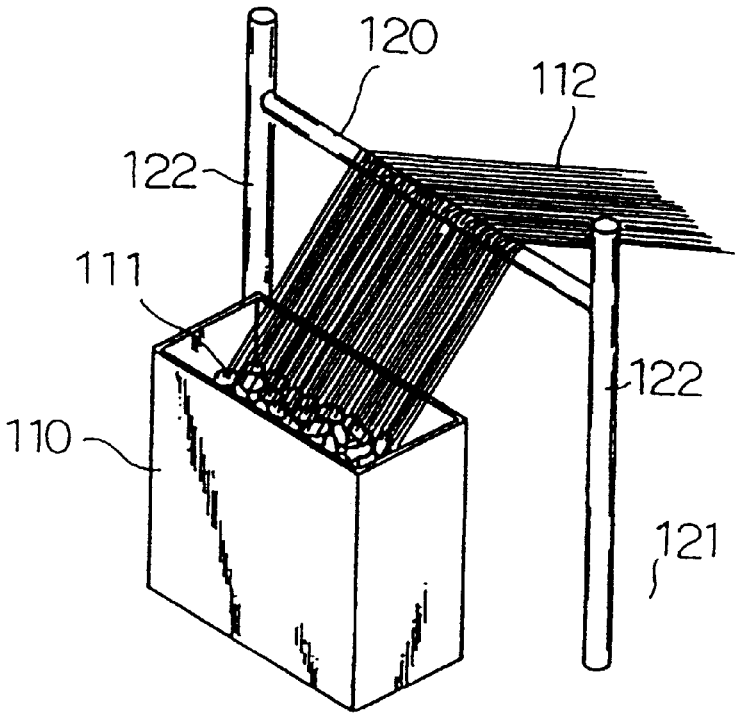
FIG. 13 is a partial perspective view showing a transverse suspension shaft of the above device.
Figure 14:
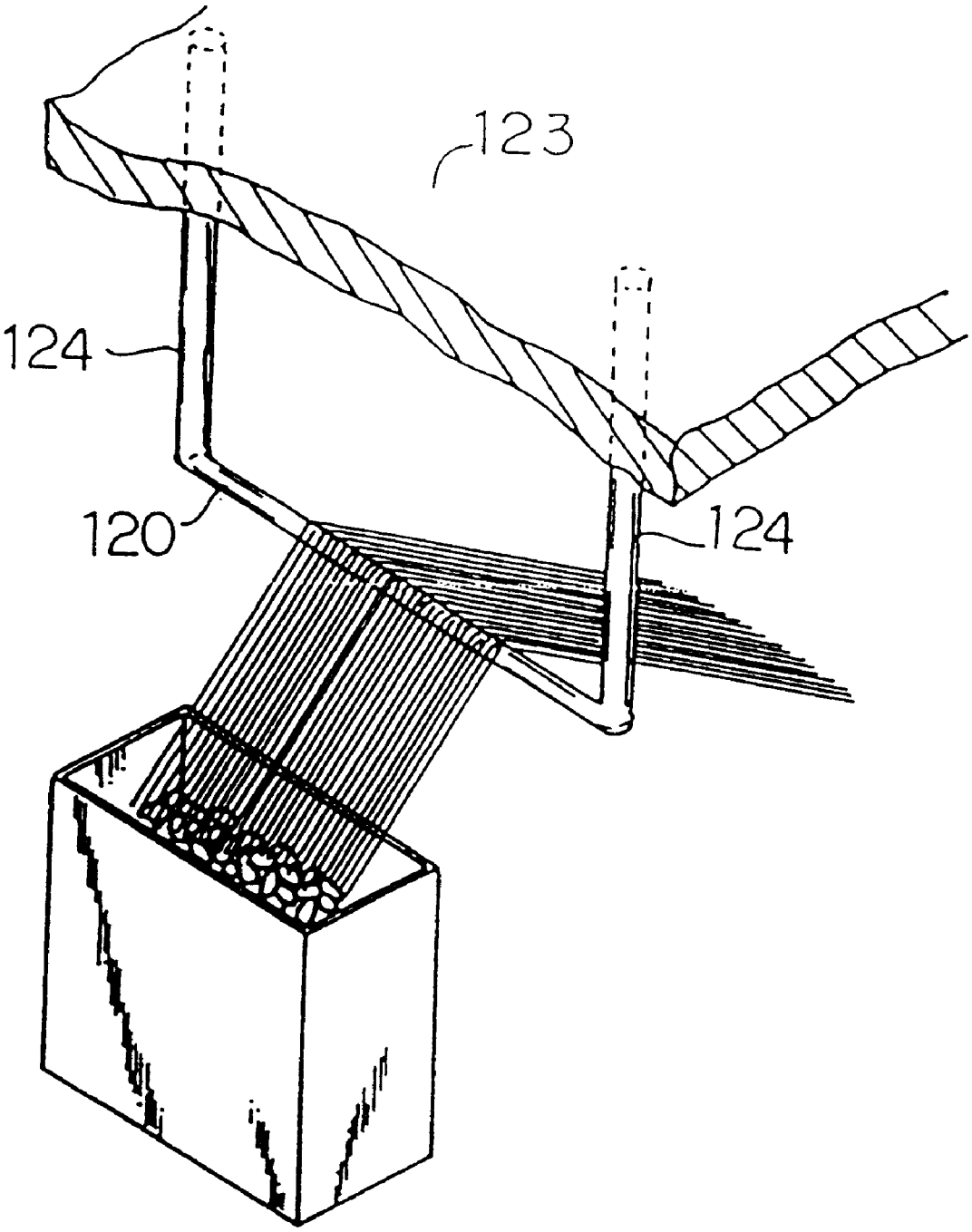
FIG. 14 is a partial perspective view showing another transverse suspension shaft of the above device.
Figure 15:
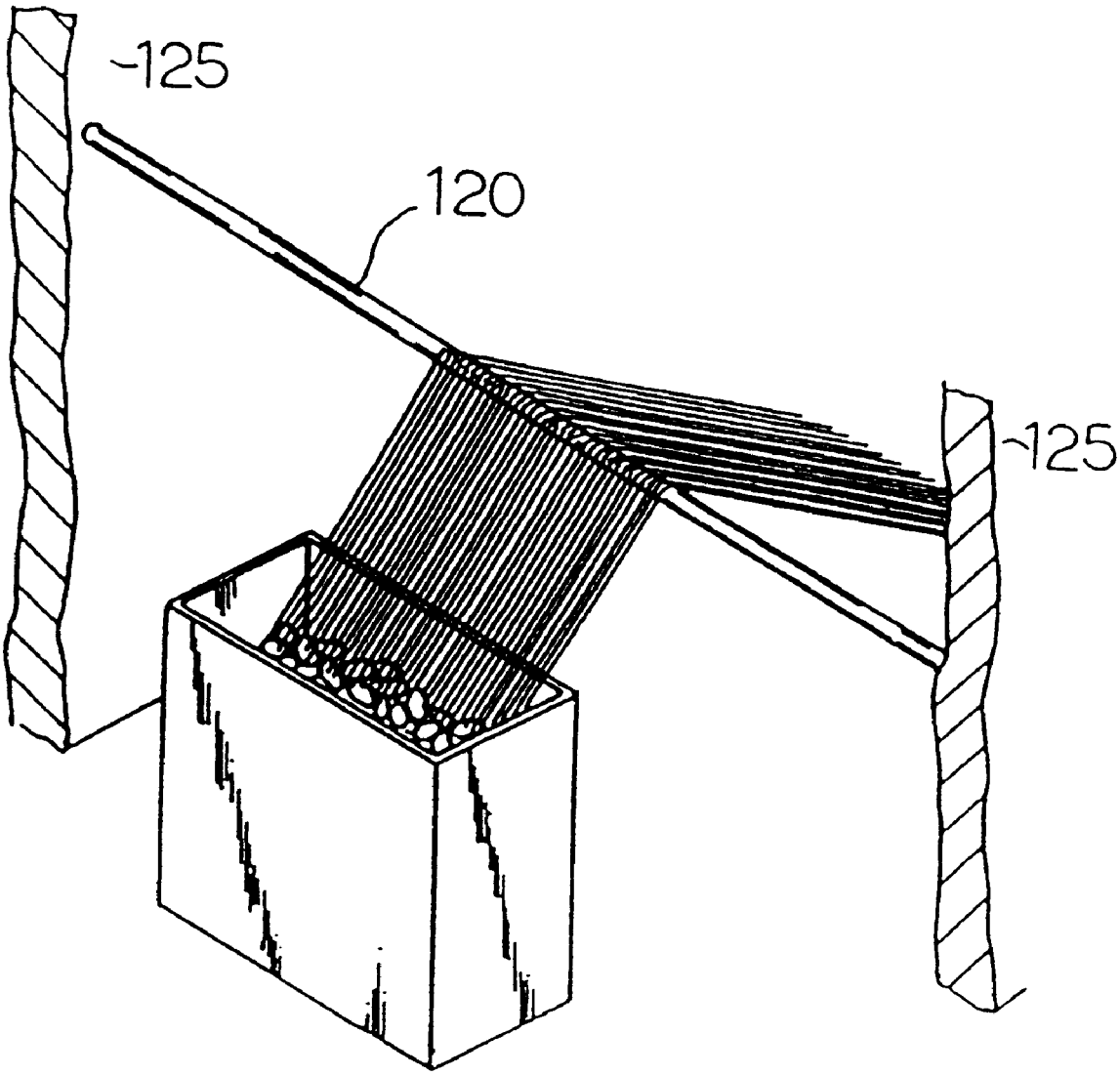
FIG. 15 is a partial perspective view showing a further transverse suspension shaft of the above device.

Cocoon threads 112 of the cocoons 111 are reeled one by one by a reeler (not shown), passed through the transverse suspension shaft 120 and reeled off the reel 130 of the automatic reeling device 140. The said transverse suspension shaft 120 is positioned between the cocoon container 110 and the reel 130, and can be positioned, for example, in the state shown in FIG. 13, 14 or 15. In FIG. 13 the transverse suspension shaft 120 is fixed in a floor part 121, suspended between two supports 122 and set up substantially H-shaped. Also, in FIG. 14 the transverse suspension shaft 120 is suspended between two supports 124 fixed in the ceiling 123. Furthermore, in FIG. 15 the transverse suspension shaft 120 is suspended between side-wall faces 125 of a workshop and the like.

Figure 16:
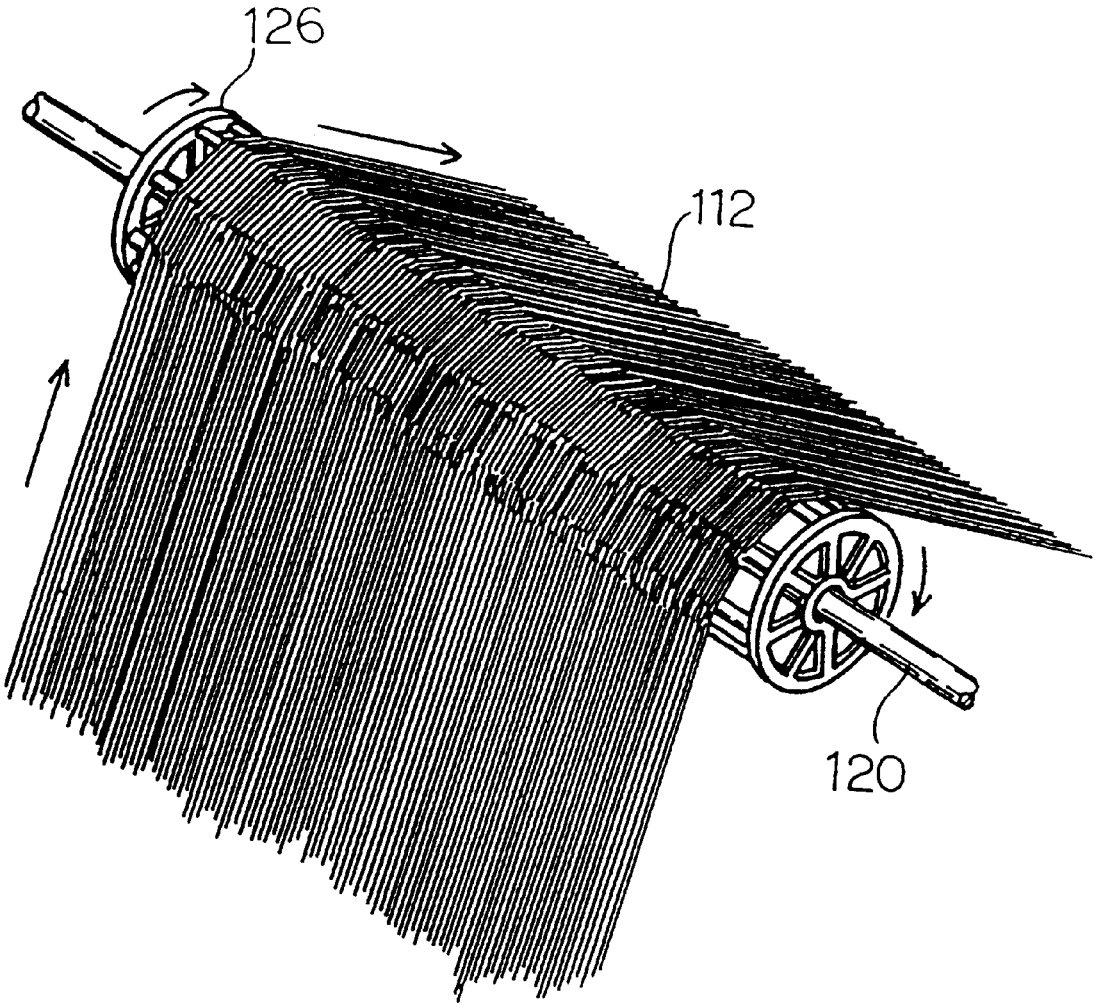
FIG. 16 is a perspective view showing a pulley part inserted into the transverse suspension shaft of the above device.

Moreover, as shown in FIG. 16, in the said transverse suspension shaft 120, it is preferable to rotatably mount a pulley part 126 consisting of polygons having suitable width. By that means, friction generated when the cocoon thread 112 passes through the transverse suspension shaft 120 is mitigated, reeling work is smoothly carried out and the cocoon thread 112 is prevented from cutting by friction. Moreover, for the transverse suspension shaft 120, various materials such as iron pipe, wire, wire rope, wood, string and the like can be used.

Figure 8:
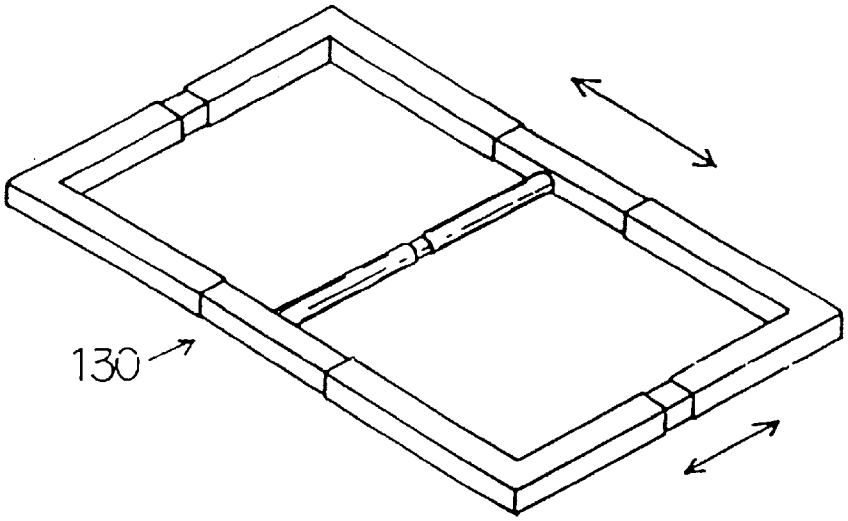
FIG. 8 is a perspective view showing a reel of the above device.

The automatic reeling device 140 is rotatably and detachably provided with a flat board-like reel 130. Such reel 130 is, as shown in FIG. 8, contractible in the longitudinal direction and the vertical direction for appropriately dealing with the size of mattress and the like. Moreover, by rotating the reel 130 in a certain direction, about 3,000 –5,000 cocoon threads 112 can usually be reeled off at one time.

The sewing device 160 is provided with a long machine 161 and a fastening frame 165. The long machine 161 consists of a pair of arms 162, detachable supports 163 and a machine part 164 being movable to the lengthwise direction of the arms 162. The fastening frame 165 is, at the time of sewing the cocoon thread 112, a fastener for fastening and fixing the reel 130.

Figure 6:
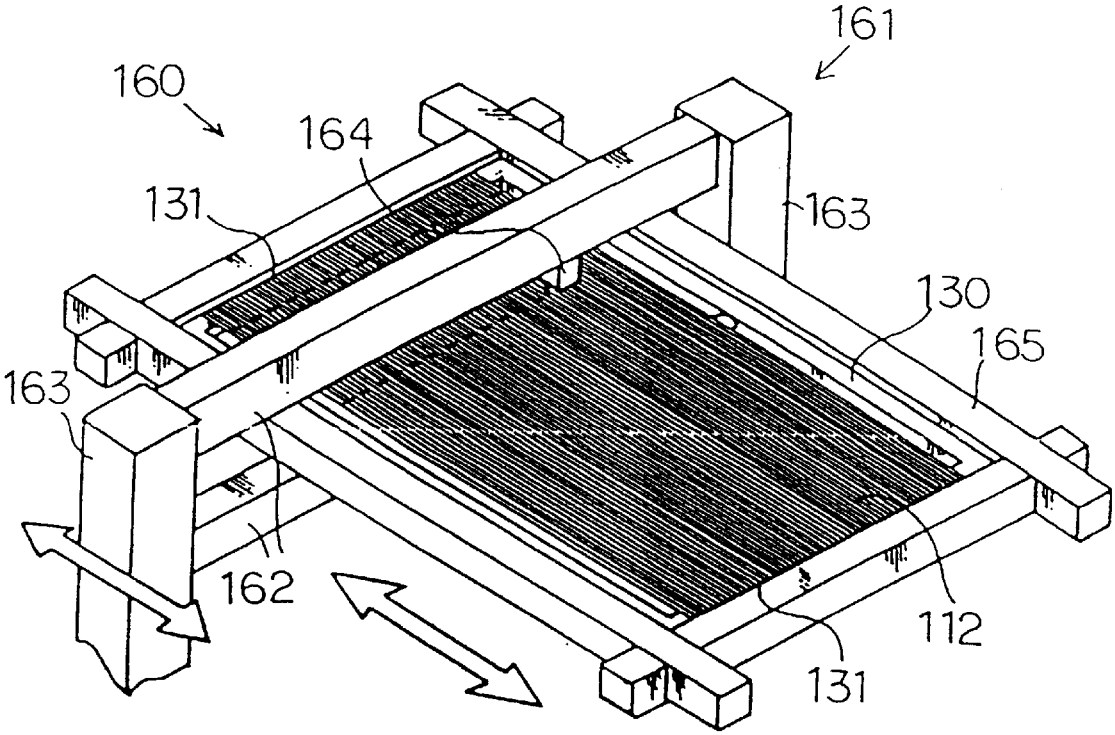
FIG. 6 is a partial perspective view showing the use condition of the above device.
Figure 7:
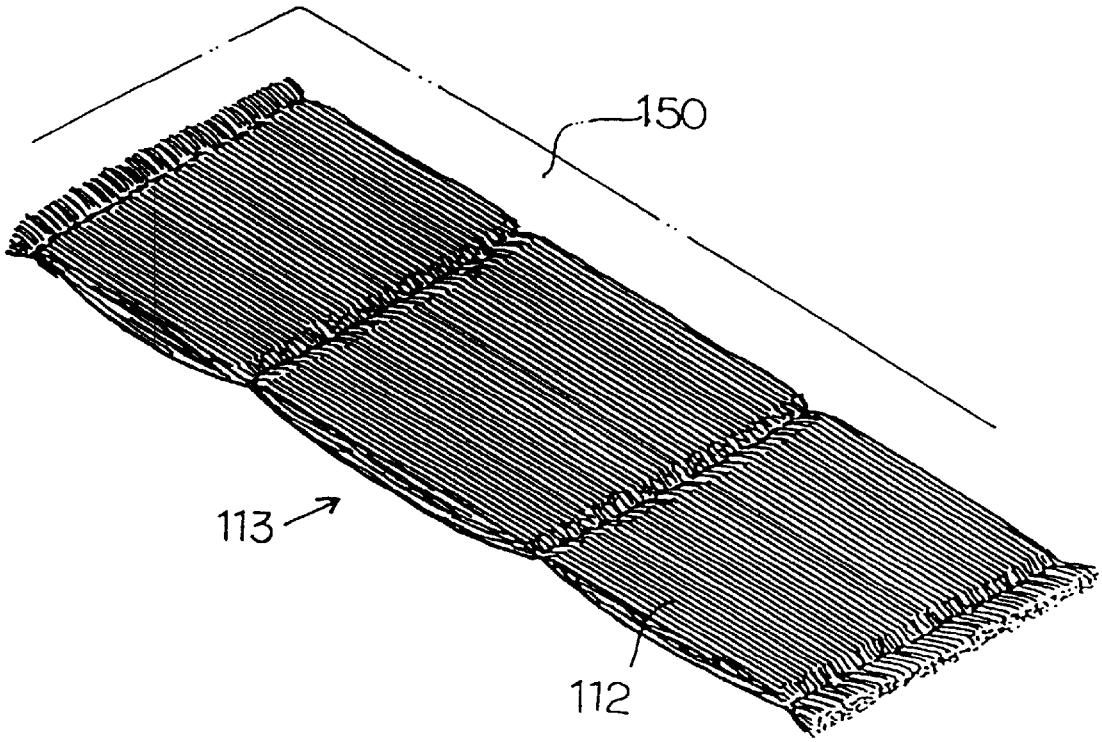
FIG. 7 is a perspective view showing a bundle of cocoon threads produced by the above device.

Next, a process for sewing cocoon threads 112 is explained by referring to FIGS. 6 and 7. The cocoon threads 112 are reeled off by serially rotating a reel 130 in a certain direction. The reel 130 is moved to a sewing device 160 and mounted within a fastening frame 165. The reel 130 and the fastening frame 165 are inserted between arms 162 of the sewing device 160, a machine part 164 is moved to the longitudinal direction of the arms 162, and several portions of the cocoon threads 112 are sewn. In addition, the fastening frame 165 and the long machine 161 are movable in arrow directions, respectively, but for example, in case of moving the fastening frame 165, the long machine 161 is fixed, and in case of moving the long machine 161, the fastening frame 165 is fixed.

After sewing, the reel 130 is removed from the fastening frame 165 and moved to the set table 150. Then, both end portions 131 of the reel 130 are cut by a cutter, the cocoon threads 112 are removed from the reel 130 and a cocoon thread bundle 113 is formed. The cocoon thread bundle 113 is in the state of bundling filamentary cocoon threads 112, so that permeability, insulating property and touch are excellent. Therefore, the cocoon threads can be utilized as stuffing of bedding and the like, and and also as a wrap, shortcoat, cushion or pillow, clothing, arctic outfits and the like.

Next, another example of the mattress stuffing producing device according the invention is explained by referring to FIGS. 9 to 12.

Figure 9:
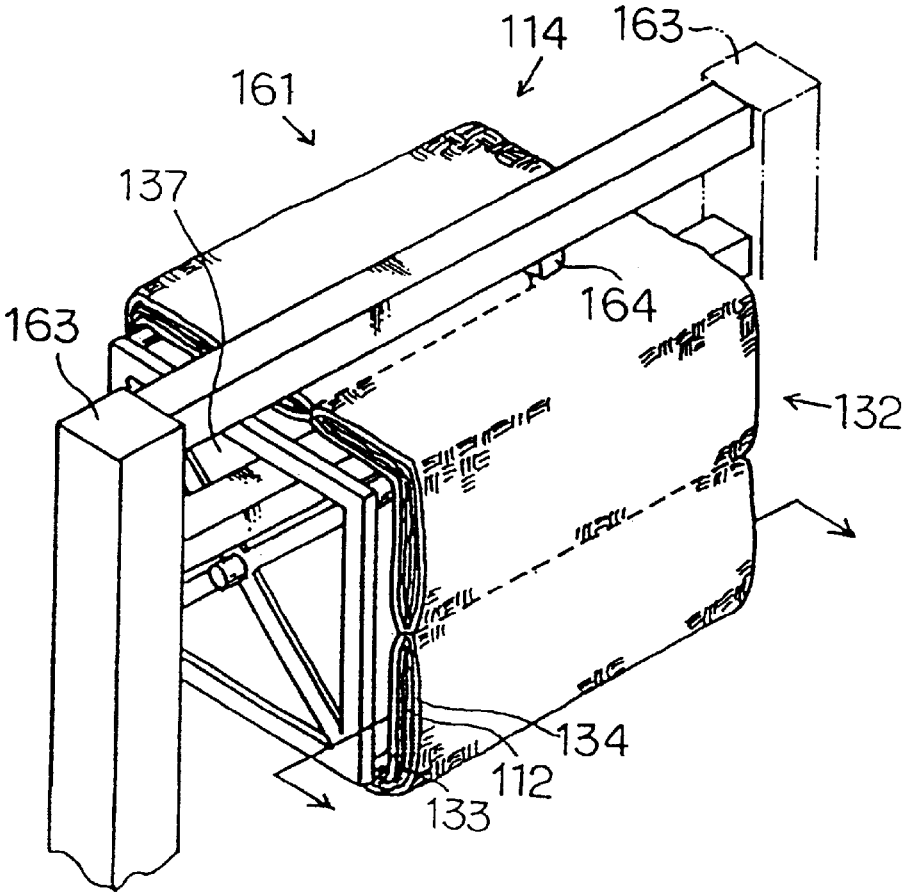
FIG. 9 is a perspective view showing a machine part of the above device.

FIG. 9 shows a tetragonal reel 132. In case of using the reel 132, first a cloth 133 such as gauze and the like is wound on the circumference of the reel 132. Thereafter, the reel 132 is rotated in a certain direction to reel off cocoon threads 112. When the cocoon threads 112 are reeled off, the whole is wound with a cloth 134 such as gauze and the like and temporarily fastened. After completing the above, one support 163 of the long machine 161 is removed, a side part 137 of the reel 132 is inserted into the portion of an arm 162, and one place is sewed by a machine part 164. Moreover, in case of the tetragonal reel 132, it is preferable to sew four sides while the reel 132 is rotated.

Figure 10:
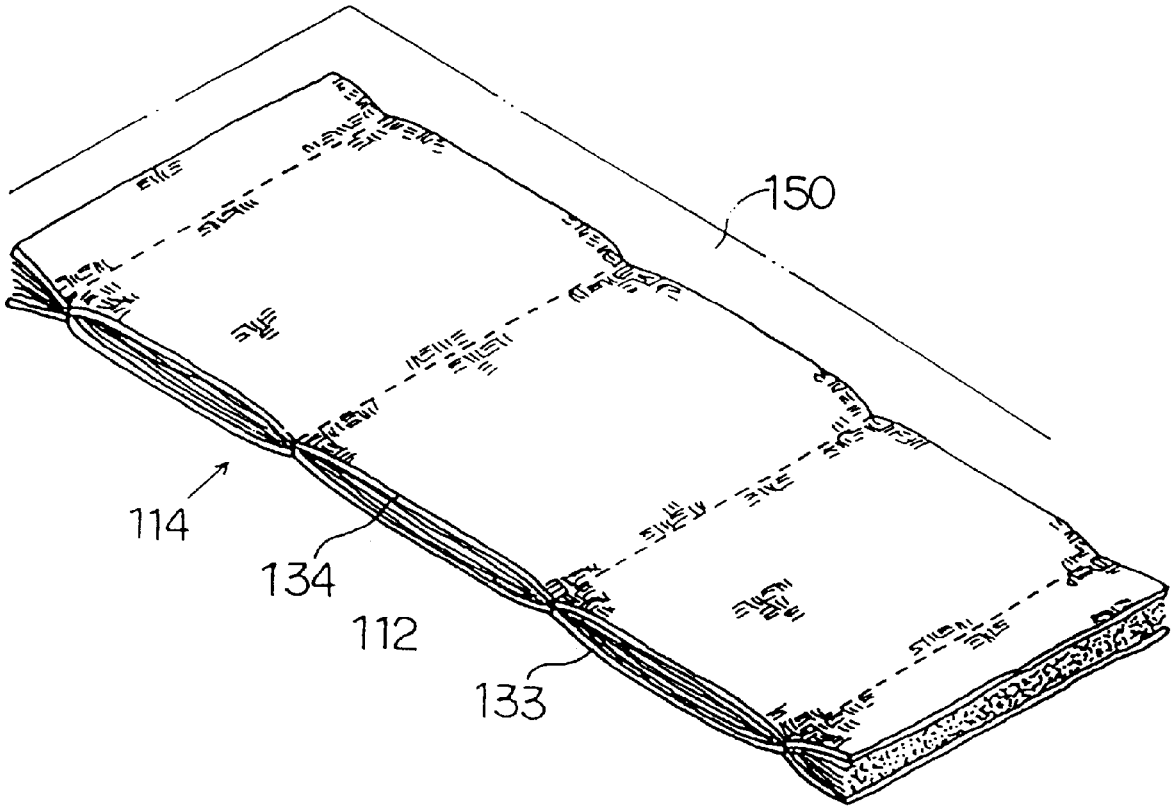
FIG. 10 is a perspective view showing another example of a bundle of cocoon threads produced by the above device.

After sewing, the reel 132 is moved to a set table 150, and one place of the cocoon thread bundle 114 is cut by a cutter. Then, as shown in FIG. 10, filamentary cocoon threads 112 are in the state of being held by cloths 133, 134. Therefore, an anti-fraying effect of the cocoon threads 112 is improved. Moreover, in the state of being held by the cloths 133, 134, the cocoon thread bundle 114 can be utilized as stuffing of not only bedding and the like but also as a wrap, shortcoat, cushion or pillow, clothing, arctic outfits and the like.

Figure 11:
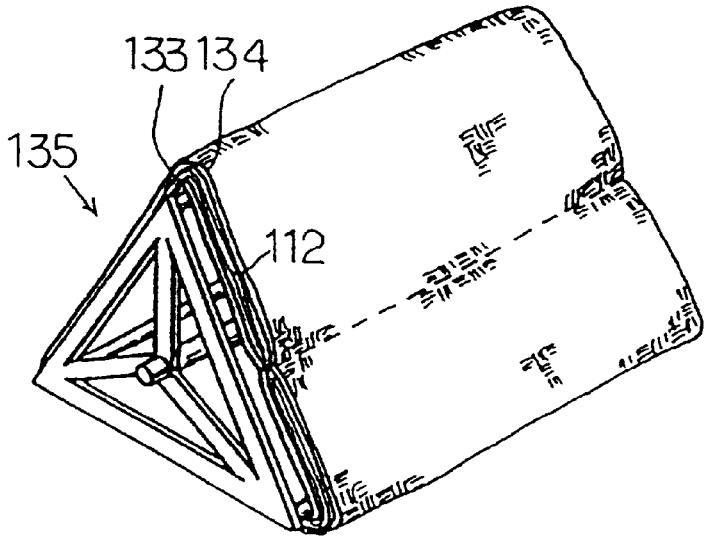
FIG. 11 is a perspective view showing another example reel of the a device.

FIG. 11 shows a trigonal reel 135, and in case of using the reel 135, first a cloth 133 such as gauze and the like is wound on the circumference of the reel 132. After that, the reel 132 is rotated in a certain direction to reel off cocoon threads 112. When the cocoon threads 112 are reeled off, the whole is wound with a cloth 134 such as gauze and the like and temporarily fastened. Moreover, in case of the trigonal reel 135, it is preferable to sew three sides while the reel 135 is rotated.

Figure 12:
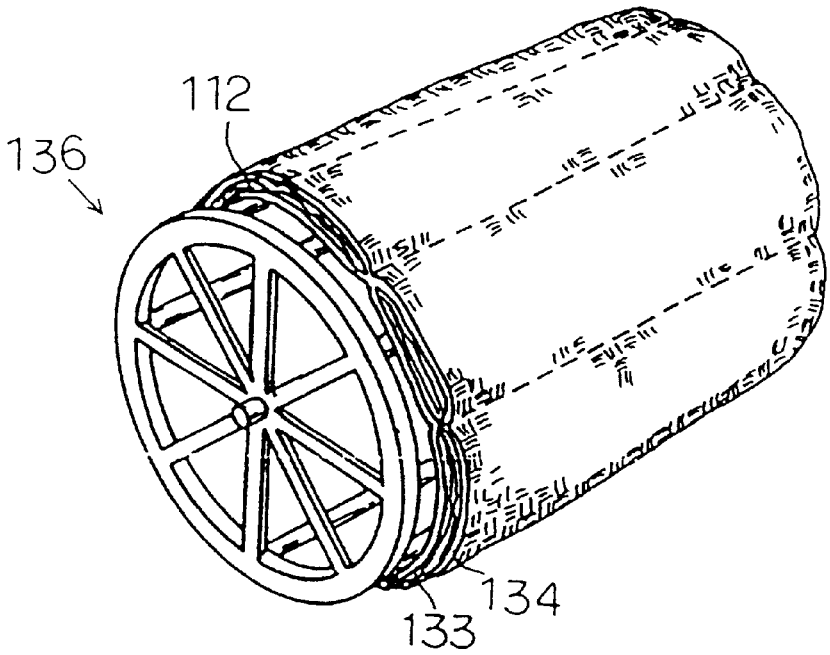
FIG. 12 is a perspective view showing a further example reel of the above device.

FIG. 12 shows a columnar reel 136, and in case of using the reel 136, first a cloth 133 such as gauze and the like is wound on the circumference of the reel 132, and the reel 132 is rotated in a certain direction to reel off cocoon threads 112. When the cocoon threads 112 are reeled off, the whole is wound with a cloth 134 such as gauze and the like and temporarily fastened. Moreover, in case of the columnar reel 136, it is preferable to sew plural portions while the reel 136 is rotated.

As explained above, the mattress of the invention separates long fibrous cocoons one by one and arranges them in the state continued from end to end of the mattress, so as to form appropriate spaces between threads, and to provide excellent insulating property. Moreover, every cocoon thread is independent, and there is no twisting or kinking trouble. Furthermore, since the cocoon thread per se contains sericin, there is moderate resiliency and toughness, thread cutting during a period of use can be mitigated, and the advantage of natural silk can effectively be exhibited, so that the high-grade feeling different from feathers can be obtained.

Moreover, the stuffing produced by the process for producing stuffing and the device of producing stuffing according to the invention is in a bundled state of a cocoon thread bundle, so that permeability, insulating property and touch are excellent; and therefore, the invention can widely be utilized as stuffing of not only bedding and the like, such as the mattress of the invention, but also as a wrap, shortcoat, cushion, pillow, clothing, arctic outfits, padding of chair and sofa and the like. Furthermore, cocoon threads are sewed in the state of winding round the reel, so that the cocoon threads can be prevented from fraying. Moreover, the reel is contractible in length and width, so as to produce a cocoon bundle of various sizes. Besides, in case of using a polygonal reel, stuffing is integrated by sandwiching with two cloths, and as a result, anti-fraying can be more improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims:

What is claimed is:

1. A mattress, comprising:

a thread bundle of long fibers, the bundle of long fibers being arranged in a repetitive pattern along a portion of the mattress;

a pair of inner layers adjacent the thread bundle, the thread bundle being between the pair of inner layers;

a quilting provided in the thread bundle, the quilting preventing movement of the thread bundle;

a surface cloth made of woven fabric, the surface cloth covering the inner layers; and a retention cloth fastening said thread bundle, said inner layers, said quilting and said surface cloth, wherein the long fibers are a cocoon thread bundle reeled from cocoon threads from a plurality of cocoons.

2. The mattress as claimed in claim 1, wherein said thread bundle of long fibers is arranged in a longitudinal direction of the mattress.

3. The mattress as claimed in claim 1, wherein said thread bundle of long fibers is arranged in a transverse direction of the mattress.

4. The mattress as claimed in claim 1, comprising two tread bundles of long fibers, one of the two thread bundles of long fibers being arranged in a longitudinal direction and another of the two thread bundles of long fibers being arranged in a transverse direction of the mattress.

5. The mattress as claimed in claim 1, further comprising a core member and two quilted thread bundles, wherein said core member is placed between the two quilted thread bundles, whereby the two quilted thread bundles cover the core member.

6. The mattress as claimed in claim 5, wherein the two quilted thread bundles are covered with an additional surface cloth.

7. The mattress as claimed in claim 1, wherein the pattern in which the long fibers are arranged is a crisscrossing pattern.

8. A process for producing a mattress stuffing, comprising the steps of:

reeling cocoon threads off a plurality of cocoon bundles and around a reel apparatus to form a wound thread bundle on the reel apparatus, the reel apparatus providing an interior space within the wound thread bundle;

sewing the cocoon threads while wound around said reel apparatus, the cocoon threads in the wound thread bundle on a opposite side of the space separating the cocoon threads failing to be sewn together during the step of sewing; and cutting and processing a bundle of sewn cocoon threads on the reel.

9. The process as claimed in claim 8, wherein the step of processing includes the step of separating ends of the wound bundle which have been cut, the wound bundle being unwound and laid flat during the step of separating to thereby form an elongated mattress stuffing.

10. The process as claimed in claim 8 wherein said cocoon threads wound onto said reel apparatus are sandwiched between two cloths, the two cloths providing a layer enclosing the cocoon threads.

11. An apparatus for producing a stuffing, comprising:

a thread bundle container having a plurality of cocoon thread bundles;

a reel apparatus reeling threads off said cocoon thread bundles to form a wound thread bundle;

a transverse suspension shaft arranged between said cocoon thread bundle container and said reel apparatus, the transverse suspension shaft supporting separated threads;

a sewing device having a long machine for sewing threads into the wound thread bundle, wherein said reel apparatus is integrated between a horizontal arm member unit having two horizontal arm members;

a sewing table arranged between said reel apparatus and said sewing device; and an additional long machine, the additional long machine adjacent said reel apparatus for stitching the wound thread bundle, wherein a fastening frame is integrated between the two horizontal and members of the horizontal arm member unit and movable in a longitudinal direction relative to the horizontal arm member unit, the fastening frame holding the thread bundle.

12. The apparatus as claimed in claim 11, wherein said additional long machine is movable in a longitudinal direction relative to the horizontal arm member unit.

13. The apparatus as claimed in claim 12, wherein one of said additional long machine and said fastening frame are movable in the longitudinal direction while the other of said additional long machine and said fastening frame are stationary.

* * * * *